US012252368B2

(12) United States Patent
Seto

(10) Patent No.: US 12,252,368 B2
(45) Date of Patent: Mar. 18, 2025

(54) SHEET FEEDING APPARATUS AND IMAGE FORMING APPARATUS

(71) Applicant: CANON KABUSHIKI KAISHA, Tokyo (JP)

(72) Inventor: Masaki Seto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 168 days.

(21) Appl. No.: 17/966,004

(22) Filed: Oct. 14, 2022

(65) Prior Publication Data

US 2023/0130978 A1 Apr. 27, 2023

(30) Foreign Application Priority Data

Oct. 25, 2021 (JP) ..... 2021-173907

(51) Int. Cl.

| | |
|---|---|
| ***B65H 1/04*** | (2006.01) |
| ***B65H 1/14*** | (2006.01) |
| ***B65H 1/26*** | (2006.01) |
| ***B65H 3/66*** | (2006.01) |

(52) U.S. Cl.

CPC ..... *B65H 3/66* (2013.01); *B65H 1/14* (2013.01); *B65H 2301/42324* (2013.01); *B65H 2701/1313* (2013.01)

(58) Field of Classification Search

CPC . B65H 1/04; B65H 1/266; B65H 1/14; B65H 2301/42324; B65H 2701/1313; B65H 2511/11; B65H 2405/1113; B65H 2405/11131; B65H 2405/1115; B65H 2405/1116; B65H 2405/11161; B65H 2405/11164

See application file for complete search history.

(56) References Cited

U.S. PATENT DOCUMENTS

| | | | | |
|---|---|---|---|---|
| 4,768,772 A * | 9/1988 | Ochiai | ..... | G03G 15/6502 D18/39 |
| 8,191,891 B2 * | 6/2012 | Yamagata | ..... | B65H 3/0607 271/148 |
| 9,272,857 B2 | 3/2016 | Nakagawa et al. | | |

(Continued)

FOREIGN PATENT DOCUMENTS

| | | | |
|---|---|---|---|
| JP | 6265838 A | * | 3/1987 |
| JP | H09309624 A | | 12/1997 |

(Continued)

*Primary Examiner* — Luis A Gonzalez

(74) *Attorney, Agent, or Firm* — ROSSI, KIMMS & McDOWELL LLP

(57) ABSTRACT

A sheet feeding apparatus includes a stacking portion, a feed member provided above the stacking portion and configured to feed an uppermost sheet among the sheets stacked on the stacking portion, and a trailing-end regulating member movable in the sheet feeding direction and configured to regulate a position of a trailing end of the sheets stacked on the stacking portion in the sheet feeding direction. The trailing-end regulating member includes a support portion configured to support a lower surface of the sheets stacked on the stacking portion. The support portion has a projecting shape in which a center portion of the support portion in a sheet width direction projects upward as compared with end portions of the support portion in the sheet width direction.

20 Claims, 8 Drawing Sheets

(56) References Cited

U.S. PATENT DOCUMENTS

| | | | | |
|---|---|---|---|---|
| 10,435,256 | B2 * | 10/2019 | Kimura | B65H 3/48 |
| 10,494,207 | B2 * | 12/2019 | Niikura | B65H 1/04 |
| 2019/0218046 | A1 * | 7/2019 | Mizuguchi | H04N 1/0066 |

FOREIGN PATENT DOCUMENTS

| | | | |
|---|---|---|---|
| JP | 2002274666 | A | 9/2002 |
| JP | 2015129044 | A | 7/2015 |

* cited by examiner

SHEET FEEDING APPARATUS AND IMAGE FORMING APPARATUS

BACKGROUND OF THE INVENTION

Field of the Invention

The present invention relates to a sheet feeding apparatus that feeds a sheet, and an image forming apparatus that forms an image on a sheet.

Description of the Related Art

An image forming apparatus such as a printer or a copier includes a sheet feeding apparatus that feeds sheets used as recording media toward an image forming portion one by one. Japanese Patent Application Laid-Open No. 2015-129044 discloses attaching an attachment including a swing plate that swings about a shaft parallel to a sheet feeding direction to a tray of a sheet feeding apparatus to be compatible with a sheet having an uneven thickness such as an envelope. According to this, when the tray ascends in a state in which an envelope stack is supported on the swing plate and the uppermost envelope abuts a feeding roller, the swing plate swings by a force received from the feeding roller via the envelope stack, and thus the inclination of the uppermost envelope is relieved.

However, according to the configuration of the document described above, the inclination in the vicinity of the trailing end of the uppermost sheet is not sufficiently relieved in some cases because the trailing end of the sheet, that is, the upstream end of the sheet in the sheet feeding direction is positioned away from the swing plate for sheets of some shapes. In the case where the inclination of the uppermost sheet is large, there is a possibility that the contact state between the feeding roller and the uppermost sheet becomes unstable, and a feeding failure occurs.

SUMMARY OF THE INVENTION

The present invention provides a sheet feeding apparatus in which sheets of various sizes having uneven thickness can be fed more stably.

According to one aspect of the invention, a sheet feeding apparatus includes a stacking portion on which sheets are stacked, a feed member provided above the stacking portion and configured to feed an uppermost sheet among the sheets stacked on the stacking portion toward a sheet feeding direction, and a trailing-end regulating member movable in the sheet feeding direction and configured to regulate a position of a trailing end of the sheets stacked on the stacking portion in the sheet feeding direction, wherein the trailing-end regulating member includes a support portion configured to support a lower surface of the sheets stacked on the stacking portion, and wherein the support portion has a projecting shape in which a center portion of the support portion in a sheet width direction projects upward as compared with end portions of the support portion in the sheet width direction, the sheet width direction being a direction perpendicular to both the sheet feeding direction and an up-down direction.

Further features of the present invention will become apparent from the following description of exemplary embodiments with reference to the attached drawings.

DESCRIPTION OF THE EMBODIMENTS

Embodiments of the present disclosure will be described below with reference to drawings.

First Embodiment

Figure 1:
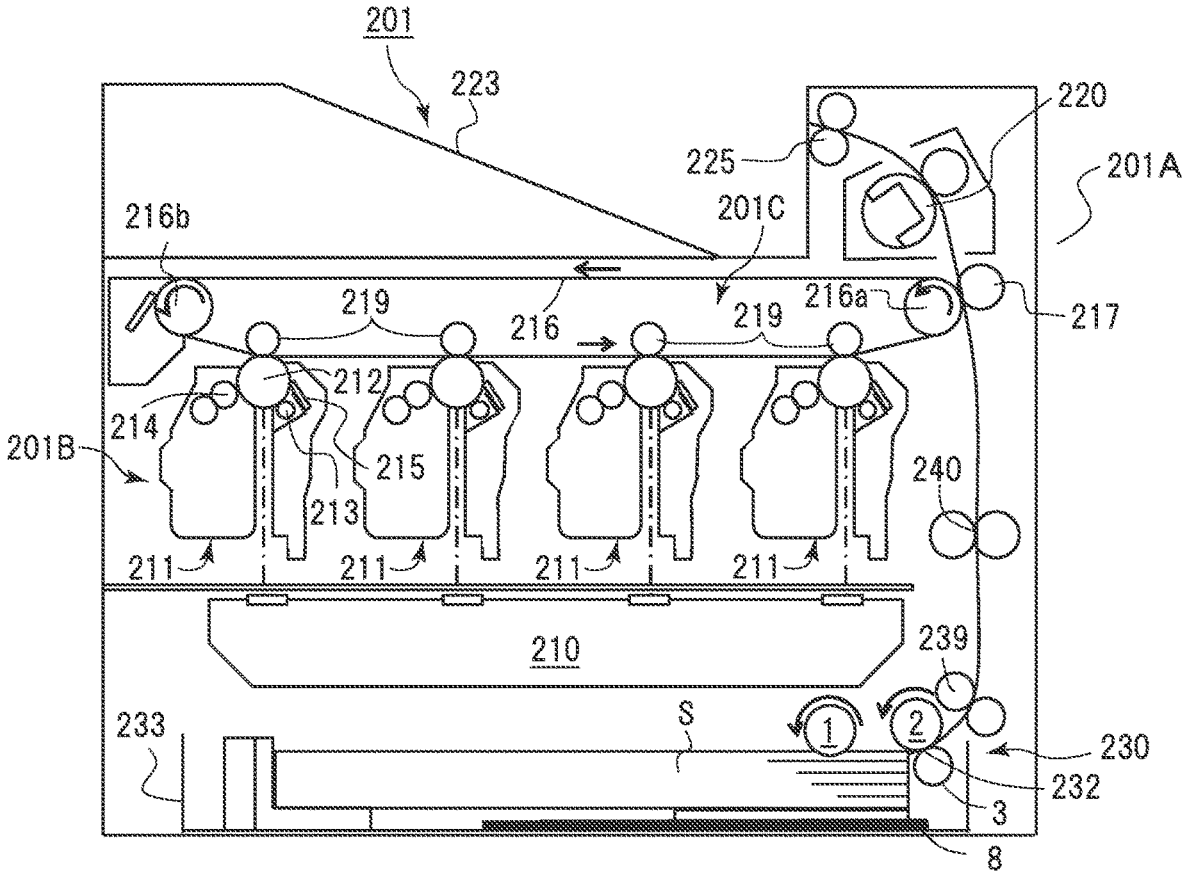
FIG. 1 is a schematic view of an image forming apparatus according to a first embodiment.

A first embodiment of the present disclosure will be described with reference to FIGS. 1 to 7. FIG. 1 is a schematic diagram illustrating an overall configuration of a full-color laser beam printer serving as an example of an image forming apparatus including a sheet feeding apparatus. The full-color laser beam printer will be hereinafter referred to as a printer 201.

The printer 201 includes a printer body 201A serving as an image forming apparatus body, an image forming portion 201B disposed in the printer body 201A, a fixing portion 220, and a sheet feeding apparatus 230.

The image forming portion 201B has a configuration of an intermediate transfer system of a tandem type. That is, the image forming portion 201B includes four process cartridges 211 that respectively form toner images of four colors of yellow, magenta, cyan, and black, and an intermediate transfer unit 201C. The process cartridges each serve as a process unit and an image forming station.

The process cartridges 211 each include a photosensitive drum 212 that is an electrophotographic photosensitive member serving as an image bearing member, a charging unit 213 serving as a charging portion, a developing unit 214 serving as a developing portion, and a cleaning blade 215 serving as a cleaning portion. The developing unit 214 includes a container that accommodates developer including toner, and a developing roller serving as a developer bearing member that rotates while bearing toner and thus supplies toner to the photosensitive drum 212. In addition, a laser scanner 210 serving as an exposing portion is disposed below the four process cartridges 211.

The intermediate transfer unit 201C includes an intermediate transfer belt 216 serving as an intermediate transfer member, a driving roller 216*a*, a tension roller 216*b*, and four primary transfer rollers 219. The intermediate transfer belt 216 is wound around, that is, stretched over the driving roller 216*a* and the tension roller 216*b*, and is conveyed by the rotation of the driving roller 216*a* while sequentially coming into contact with the photosensitive drums 212 of the process cartridges 211. The four primary transfer rollers 219 are provided in an inner space of the intermediate transfer belt 216, and are disposed at positions opposing respective photosensitive drums 212 with the intermediate transfer belt 216 therebetween.

A secondary transfer roller 217 serving as a transfer portion that transfers a toner image formed by the image forming portion 201B onto a sheet S serving as a recording material or a recording medium is disposed at a position opposing the driving roller 216*a* with the intermediate transfer belt 216 therebetween. As a nip portion between the secondary transfer roller 217 and the intermediate transfer belt 216, a secondary transfer portion where the transfer of the toner image onto the sheet S is performed is formed.

A fixing portion 220 is disposed downstream of the secondary transfer portion in the sheet conveyance direction. The fixing portion 220 includes a rotary member pair that is constituted by rollers, belts, or the like and nips and conveys the sheet S, and a heating portion that heats the toner image on the sheet S. As the heating portion, a halogen lamp that generates radiant heat, a ceramic heater that heats the rollers or belts by non-radiant heat, an induction heating mechanism that heats the rollers or belts by electromagnetic induction, or the like can be used.

A discharge roller pair 225 serving as a discharge portion that discharges the sheet S on which an image has been already formed from the printer body 201A is disposed further downstream of the fixing portion 220. In addition, a discharge tray 223 that supports the sheet S on which the image has been formed is provided in an upper surface portion of the printer body 201A.

The sheet feeding apparatus 230 includes a feed cassette 233, a feeding roller 1 serving as a pickup roller, a conveyance roller 2 serving as a feed roller, and a separation roller 3. The sheet feeding apparatus 230 is configured to feed sheets S one by one toward the image forming portion 201B. To be noted, as the sheet S, various sheet materials of different sizes and materials can be used. Examples of the various sheet materials include paper sheets such as plain paper sheets and cardboards, plastic films, cloths, surface-treated sheet materials such as coated paper sheets, and sheet materials of irregular shapes such as index paper sheets. Particularly, the sheet feeding apparatus 230 of the present embodiment is capable of feeding a sheet S having an uneven thickness such as an envelope. Examples of the sheet having an uneven thickness include, in addition to envelopes, sheet materials on which recesses and projections are provided by emboss processing or partial resin coating, and paper sheets on which stamps, stickers, and the like are stuck.

The feed cassette 233 is detachably attached to the printer body 201A. The feed cassette 233 is a storage in which the sheets S are stored (i.e., an accommodation portion that accommodates the sheets S). The feed cassette 233 includes a lifter tray 8 that supports the sheets S stacked thereon. The lifter tray 8 is configured to be capable of ascending and descending as will be described later.

The feeding roller 1 is provided above the lifter tray 8. The feeding roller 1 functions as a feed member that feeds the uppermost sheet of the sheets S stacked and stored in the feed cassette 233. To be noted, as the feed member, for example, a belt member may be used instead of the feeding roller 1.

The conveyance roller 2 and the separation roller 3 constitute a separation roller pair serving as a conveyance unit that conveys sheets S fed by the feeding roller 1 one by one while separating the sheets S from each other. The conveyance roller 2 rotates along a sheet feeding direction of the feeding roller 1. The separation roller 3 is in pressure contact with the conveyance roller 2, and separates sheets S at a separation portion 232 that is a nip portion between the conveyance roller 2 and the separation roller 3. As the separation roller 3, for example, a roller member that is coupled, via a torque limiter, to a shaft member fixed to a frame member of the feed cassette 233 can be used. The separation roller 3 is an example of a separation member that separates sheets from each other, and as the separation member, for example, a roller member that receives a driving force in a direction against the rotation of the conveyance roller 2, that is, a retard drive via a torque limiter, or an elastic member of a pad shape such as a rubber pad may be used. To be noted, the feeding roller 1, the conveyance roller 2, and the separation roller 3 are each a roller including a member having a high friction coefficient such as rubber wrapped around the outer circumferential surface thereof.

A pull-out roller pair 239 is disposed downstream of the separation roller pair in the sheet conveyance direction. A registration roller pair 240 is disposed downstream of the pull-out roller pair 239 and upstream of the secondary transfer portion.

Image Forming Operation

The outline of an image forming operation by the printer 201 will be described. First, when an image forming instruction (print job) is input to the printer 201 from an external computer, a controller of the printer 201 starts the image forming operation.

When the image forming operation is started, driving of the photosensitive drums 212 and the intermediate transfer belt 216 is started in the image forming portion 201B, and the charging units 213 uniformly charge the surface of the photosensitive drums 212 to a predetermined polarity and potential. The laser scanner 210 irradiates the photosensitive drums 212 with laser light modulated in accordance with a video signal generated on the basis of image information input when the print job is input. As a result of this, the photosensitive drums 212 are exposed, and thus electrostatic latent images corresponding to respective color component images are formed on the surface of the photosensitive drums 212. The developing units 214 develop the electrostatic latent images by using developer containing toner of respective colors. As a result of this, monochromatic toner images of respective colors are formed on the surface of the photosensitive drums 212.

The monochromatic toner images formed on the photosensitive drums 212 of the process cartridges 211 are sequentially transferred onto the intermediate transfer belt 216 by the primary transfer rollers 219 through primary transfer. In the primary transfer, the monochromatic toner images of respective colors are superimposed on one another on the intermediate transfer belt 216, and thus a full-color toner image is formed on the intermediate transfer belt 216. The full-color toner image is borne on the intermediate transfer belt 216, and is conveyed toward the secondary transfer portion.

In parallel with the toner image formation process described above, the sheet feeding apparatus 230 feeds the sheets S one by one. First, the lifter tray 8 ascends and thus the uppermost sheet among the sheets S in the feed cassette 233 abuts the feeding roller 1. The feeding roller 1 is rotationally driven by an unillustrated motor, and delivers out the sheet S by frictional force. When a plurality of the sheet S are delivered out by the feeding roller 1, one of the sheets S is separated from the remaining sheets S when passing the separation portion 232. Specifically, in the case where only one of the sheets S enters the separation portion 232, the separation roller 3 rotates in accordance with the sheet S and allows passage of the sheet S. In contrast, in the case where a plurality of sheets S enter the separation portion 232, the separation roller 3 rotates in a direction against the sheet feeding direction while sliding the sheets on one another, and thus prevents the other sheets S than the uppermost sheet S from passing the separation portion 232.

The sheet S having passed the separation portion 232 is conveyed to the registration roller pair 240 via the pull-out roller pair 239. The registration roller pair 240 corrects the skew of the sheet S, and then conveys the sheet S to the secondary transfer portion at a timing matching arrival at the secondary transfer portion of the toner image borne and conveyed on the intermediate transfer belt 216. Then, when the sheet S passes the secondary transfer portion, a predetermined transfer voltage is applied to the secondary transfer roller 217, and thus the toner image is transferred from the intermediate transfer belt 216 onto the sheet S.

The sheet S onto which the toner image has been transferred is conveyed to the fixing portion 220. The fixing portion 220 heats and pressurizes the toner image on the sheet S while conveying the sheet S, and thus fixes the toner image to the sheet S. The sheet S having passed the fixing portion 220 is discharged by the discharge roller pair 225, and is supported on the discharge tray 223 as a product.

Feed Cassette

Figure 2A:
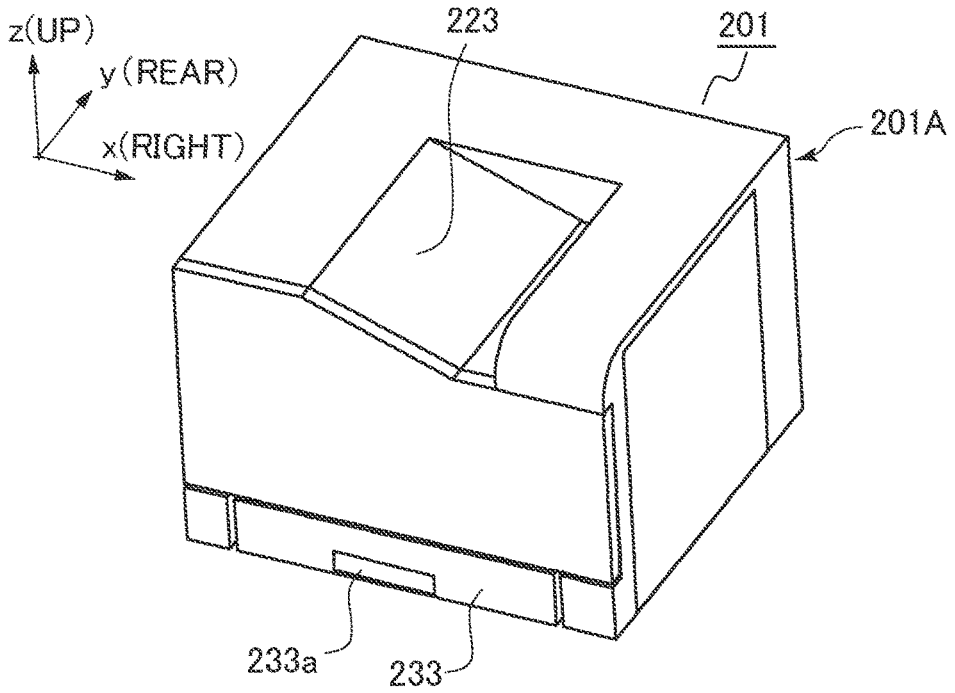
FIGS. 2A and 2B are each a perspective view of the image forming apparatus according to the first embodiment.
Figure 2B:
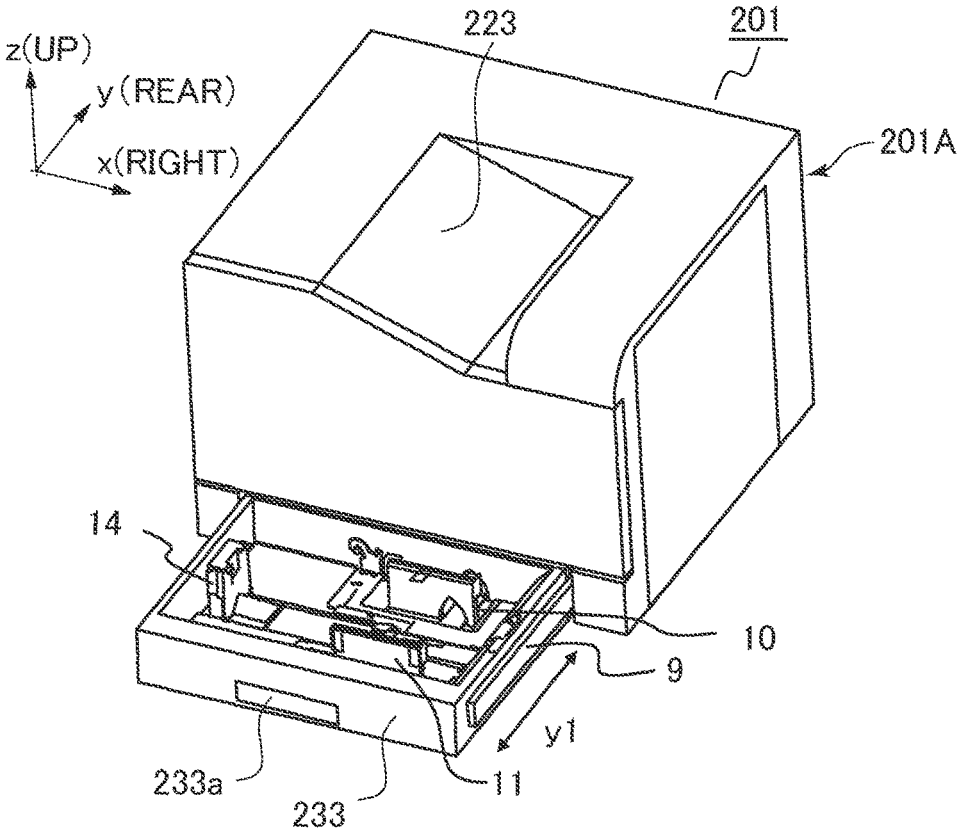

The configuration of the feed cassette 233 will be described. FIGS. 2A and 2B are each a perspective view of the printer 201 as viewed from diagonally above. FIG. 2A illustrates a state in which the feed cassette 233 is accommodated in or attached to the printer body 201A, and FIG. 2B illustrates a state in which the feed cassette 233 is drawn out from the printer body 201A.

In the description below and drawings, the vertical direction in a state in which the printer 201 is placed on a horizontal surface, that is, the gravity direction will be referred to as an up-down direction, and particularly, upward in the vertical direction will be referred to as a z direction. Among directions orthogonal to the z direction, a direction in which the feed cassette 233 is attached to and detached from the printer body 201A will be referred to as a front-rear direction of the printer 201, and particularly, the direction from the front side toward the rear side will be referred to as a y direction. A direction orthogonal to the z direction and the y direction will be referred to as a left-right direction of the printer 201, and particularly, the direction from the left side toward the right side will be referred to as an x direction. In addition, the positional relationship and the like of the feed cassette 233 and constituent elements thereof will be described with the state in which the feed cassette 233 is attached to the printer body 201A as a standard.

As illustrated in FIG. 2A, the feed cassette 233 is exposed to a front side surface of the printer body 201A. A handle portion 233*a* serving as a grip portion for operating the feed cassette 233 is provided on the front side surface of the feed cassette 233. The user can draw out the feed cassette 233 from the printer body 201A as illustrated in FIG. 2B or attach the feed cassette 233 to the printer body 201A as illustrated in FIG. 2A, by gripping the handle portion 233*a* and operating the handle portion 233*a* in a y1 direction approximately parallel to they axis.

Figure 3A:
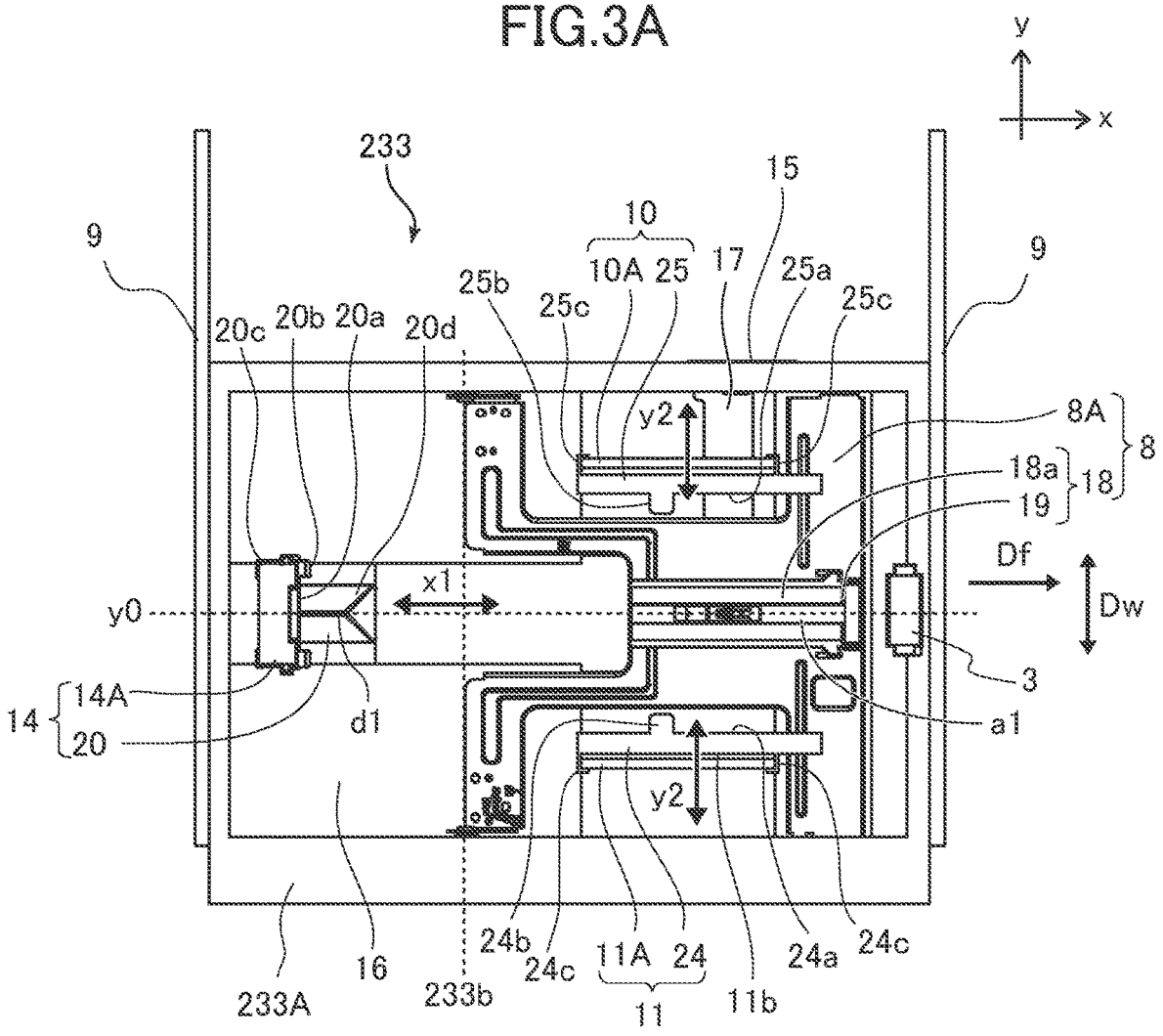
FIG. 3A is a top view of a feed cassette according to the first embodiment.

To be noted, slide rails 9 extending in the front-rear direction are disposed on respective side surfaces on the left and right sides of the feed cassette 233. Although only the slide rail 9 on one side is illustrated in FIG. 2B, a similar slide rail 9 is disposed on the other side as illustrated in FIG. 3A. The printer body 201A is provided with guide shapes that guide the slide rails 9, and the movement direction of the feed cassette 233 is restricted to the y1 direction as a result of the slide rails 9 serving as guided portions being guided by the guide shapes.

As illustrated in FIG. 2B, the feed cassette 233 is provided with a pair of side-end regulating members 10 and 11 and a trailing-end regulating member 14.

Figure 3B:
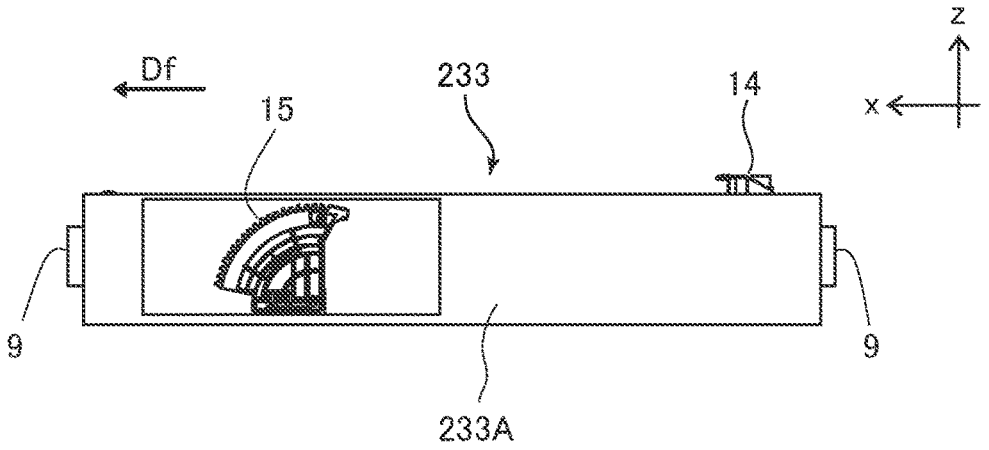
FIG. 3B is a back view of the feed cassette according to the first embodiment.

A configuration of the feed cassette 233 will be further described with reference to FIGS. 3A and 3B. FIG. 3A is a top view of the feed cassette 233, and FIG. 3B is a back view of the feed cassette 233 as viewed from the rear side.

A sheet accommodated in the feed cassette 233 is fed in a sheet feeding direction Df approximately parallel to the x axis as viewed from above as illustrated in FIG. 3A. In the description below, a downstream end of the sheet in the sheet feeding direction Df will be referred to as a "leading end" of the sheet, and an upstream end of the sheet in the sheet feeding direction Df will be referred to as a "trailing end" of the sheet. In addition, a direction orthogonal to both the sheet feeding direction Df and the up-down direction (z direction), that is, a direction approximately parallel to the y axis will be referred to as a sheet width direction Dw, and end portions of the sheet in the sheet width direction Dw will be referred to as "side ends" of the sheet.

As illustrated in FIG. 3A, the feed cassette 233 of the present embodiment includes a cassette body 233A, the lifter tray 8, a lifter arm 17, the pair of side-end regulating members 10 and 11, the trailing-end regulating member 14, the slide rails 9, and the separation roller 3.

The cassette body 233A is a frame member having a substantially rectangular parallelepiped shape opening upward. The lifter tray 8 includes a tray body 8A supported to be swingable about a swing shaft 233*b* that is a boss portion provided in the cassette body 233A, and a tray attachment 18 detachably attached to the tray body 8A. The tray attachment 18 will be described later. The tray body 8A can support sheets also in a state in which the tray attachment 18 is detached. The lifter tray 8 is an example of a lifting/lowering member capable of ascending and descending with respect to a bottom portion 16 of the feed cassette 233, and may be configured to move up and down while maintaining an approximately horizontal orientation instead of swinging about the swing shaft 233*b*.

The lower surface of the sheets accommodated in the feed cassette 233 is supported by the lifter tray 8 and the bottom portion 16 of the cassette body 233A. That is, the lifter tray 8 serving as a lifting/lowering member and the bottom portion 16 of the cassette body 233A constitute a stacking portion that supports the sheets stacked thereon in the feed cassette 233 serving as a storage.

The lifter arm 17 is disposed between the tray body 8A of the lifter tray 8 and the bottom portion 16 of the cassette body 233A, pivots by a driving force supplied from a motor of the printer body 201A, and thus lifts/lowers the lifter tray 8. As illustrated in FIG. 3B, a lifter gear 15 serving as an input gear for receiving a driving force from a drive gear serving as an output gear of the printer body 201A and transmitting the driving force to the lifter arm 17 is disposed on the rear side of a side surface of the feed cassette 233. The lifter arm 17 integrally rotates about a shaft portion shared with the lifter gear 15. To be noted, the mechanism that lifts and lowers the lifter tray 8 serving as a lifting/lowering member is not limited to a lifter arm, and for example, the lifter tray 8 may be lifted and lowered by reeling in and out a wire hanging the lifter tray 8 by the driving force of the motor.

As illustrated in FIG. 3A, the side-end regulating members 10 and 11 serving as side fences or side guides are supported by the bottom portion 16 of the cassette body 233A that is a bottom plate. The side-end regulating members 10 and 11 are provided to oppose each other in the front-rear direction, and are each configured to be slidable, that is, movable or position-adjustable in a y2 direction approximately parallel to the y axis with respect to the cassette body 233A. The side-end regulating members 10 and 11 respectively have regulating surfaces 24*a* and 25*a* serving as an abutting surface and a second abutting surface that extend in a direction approximately perpendicular to the y axis. The side-end regulating members 10 and 11 are positioned in accordance with the size of the sheets, and thus regulate the side-end positions of the sheets by abutting the side ends of the sheets by the regulating surfaces 24*a* and 25*a*.

The side-end regulating members 10 and 11 are configured to operate in an interlocked manner via, for example, a rack-and-pinion mechanism. As a result of this, the side-end regulating members 10 and 11 move while maintaining a positional relationship symmetrical with respect to a conveyance center y0 in the sheet width direction Dw. The conveyance center y0 is a center position in the sheet width direction Dw of a contact range where the feeding roller 1 comes into contact with a sheet on the lifter tray 8. To be noted, cutout portions serving as recess portions where part of side ends of the tray body 8A in the sheet width direction Dw is cut out toward the conveyance center y0 are provided in the lifter tray 8 to allow movement of the side-end regulating members 10 and 11.

The trailing-end regulating member 14 serving as a trailing-end fence or a trailing-end guide is supported by the bottom portion 16 of the cassette body 233A. The trailing-end regulating member 14 is configured to be slidable, that is, movable or position-adjustable in an xl direction approximately parallel to the x axis with respect to the cassette body 233A. The trailing-end regulating member 14 has a regulating surface 20*a* serving as an abutting surface or a first abutting surface that extends in a direction approximately perpendicular to the x axis. The trailing-end regulating member 14 is positioned in accordance with the size of the sheets, and thus regulates the trailing-end position of the sheets by abutting the trailing end of the sheets by the regulating surface 20*a*. To be noted, a cutout portion serving as a recess portion where a center portion of an upstream end of the tray body 8A in the sheet feeding direction Df is cut out toward the downstream side in the sheet feeding direction Df is provided in the lifter tray 8 to allow movement of the trailing-end regulating member 14.

The side-end regulating members 10 and 11 and the trailing-end regulating member 14 are respectively constituted by body portions 10A, 11A, and 14A that themselves function as side-end regulating members and a trailing-end regulating member, and attachments 24, 25, and 20 respectively attached thereto. The side-end attachments 24 and 25 are attachments respectively detachably attached to the body portions 10A and 11A of the side-end regulating members 10 and 11. The trailing-end attachment 20 is an attachment detachably attached to the body portion 14A of the trailing-end regulating member 14. The configurations of the body portions 10A, 11A, and 14A and the attachments 24, 25, and 20 will be described in detail later.

Figure 4A:
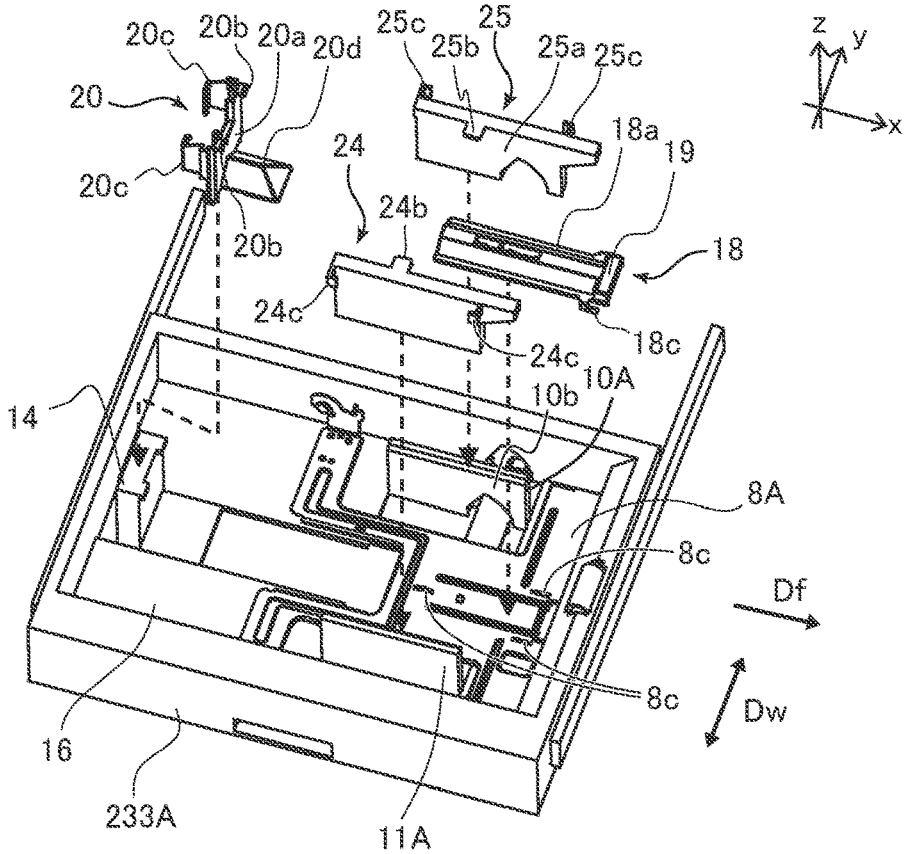
FIG. 4A is an exploded view of the feed cassette according to the first embodiment.

The body portions 10A, 11A, and 14A of the side-end regulating members 10 and 11 and the trailing-end regulating member 14 are capable of regulating the position of the sheets even in a state in which the attachments 24, 25, and 20 are detached. That is, as illustrated in FIGS. 3A and 4A, the body portions 10A and 11A of the side-end regulating members 10 and 11 respectively include regulating surfaces 10*b* and 11*b* serving as sheet abutting surfaces extending in a direction approximately perpendicular to the y axis. In addition, the body portion 14A of the trailing-end regulating member 14 includes a regulating surface 14*b* serving as a sheet abutting surface extending in a direction approximately perpendicular to the x axis. Therefore, by positioning the body portions 10A, 11A, and 14A of the side-end regulating members 10 and 11 and the trailing-end regulating member 14 in accordance with the sheet size, the positions of the side ends and trailing end of the sheets can be regulated by the regulating surfaces 10*b*, 11*b*, and 14*b*.

To be noted, the regulating surfaces 24*a* and 25*a* of the side-end attachments 24 and 25 attached to the body portions 10A and 11A of the side-end regulating members 10 and 11 are positioned further on the inside than, that is, closer to the conveyance center y0 than the regulating surfaces 10*b* and 11*b* of the body portions 10A and 11A in the sheet width direction Dw. In addition, the regulating surface 20*a* of the trailing-end attachment 20 attached to the body portion 14A of the trailing-end regulating member 14 is positioned downstream of the regulating surface 14*b* of the body portion 14A in the sheet feeding direction Df Therefore, in the state in which the attachments 24, 25, and 20 are attached, sheets having smaller sizes in the sheet width direction Dw or the sheet feeding direction Df than in the state before attachment can be supported in the feed cassette 233.

Attachments for Envelopes

Figure 4B:
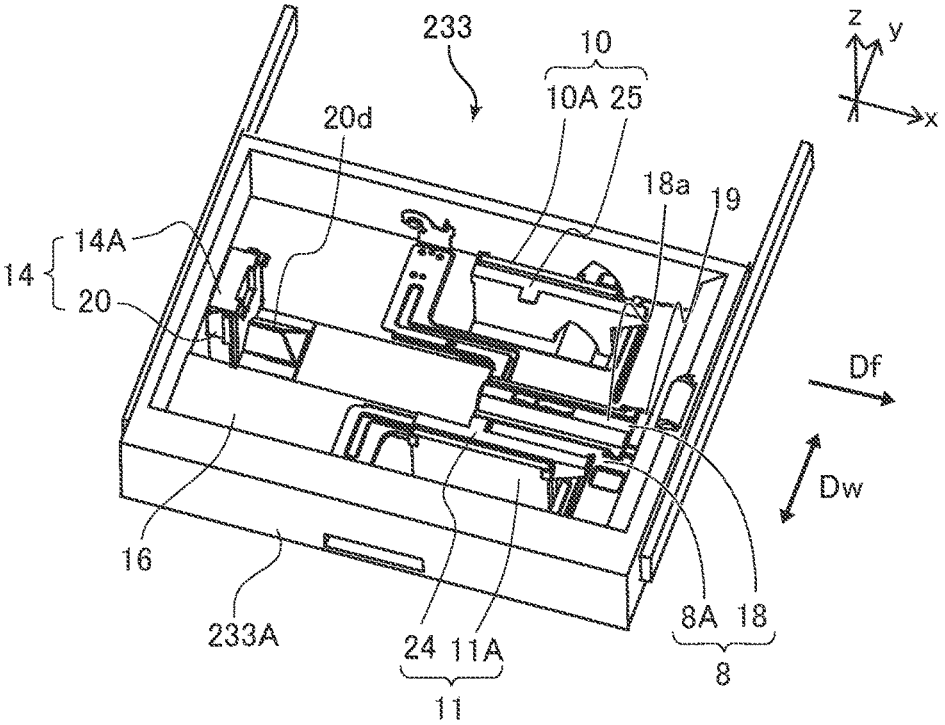
FIG. 4B is a perspective view of the feed cassette according to the first embodiment.

Details of the tray attachment 18, the trailing-end attachment 20, and the side-end attachments 24 and 25 will be described. FIG. 4A is an exploded view of the feed cassette 233 illustrating how the tray attachment 18, the trailing-end attachment 20, and the side-end attachments 24 and 25 are attached to the feed cassette 233. FIG. 4B is a perspective view of the feed cassette 233 to which the attachments are attached.

To be noted, as one of main use cases of the attachments 18, 20, 24, and 25 described above, a case where envelopes are stacked in the feed cassette 233 can be considered. However, sheets other than envelopes may be stacked in the state in which the attachments 18, 20, 24, and 25 are attached.

Tray Attachment

The tray attachment 18 includes a front supporting stage 18*a* serving as an envelope front portion supporting stage and a friction sheet 19 as illustrated in FIGS. 3A, 4A, and 4B.

The front supporting stage 18*a* is a member having a thin and elongated shape in which a projecting shape whose center portion a1 (see FIG. 7C) in the sheet width direction Dw projects upward as compared with end portions a2 thereof in the sheet width direction Dw continuously extends in the sheet feeding direction Df. The front supporting stage 18*a* is disposed at a center portion of the lifter tray 8 in the sheet width direction Dw. Specifically, as illustrated in FIG. 3A, the front supporting stage 18*a* is disposed at a position overlapping the conveyance center y0 as viewed from above, and preferably a center portion a1 of the front supporting stage 18*a* is disposed on a straight line of the conveyance center y0.

Figure 6A:
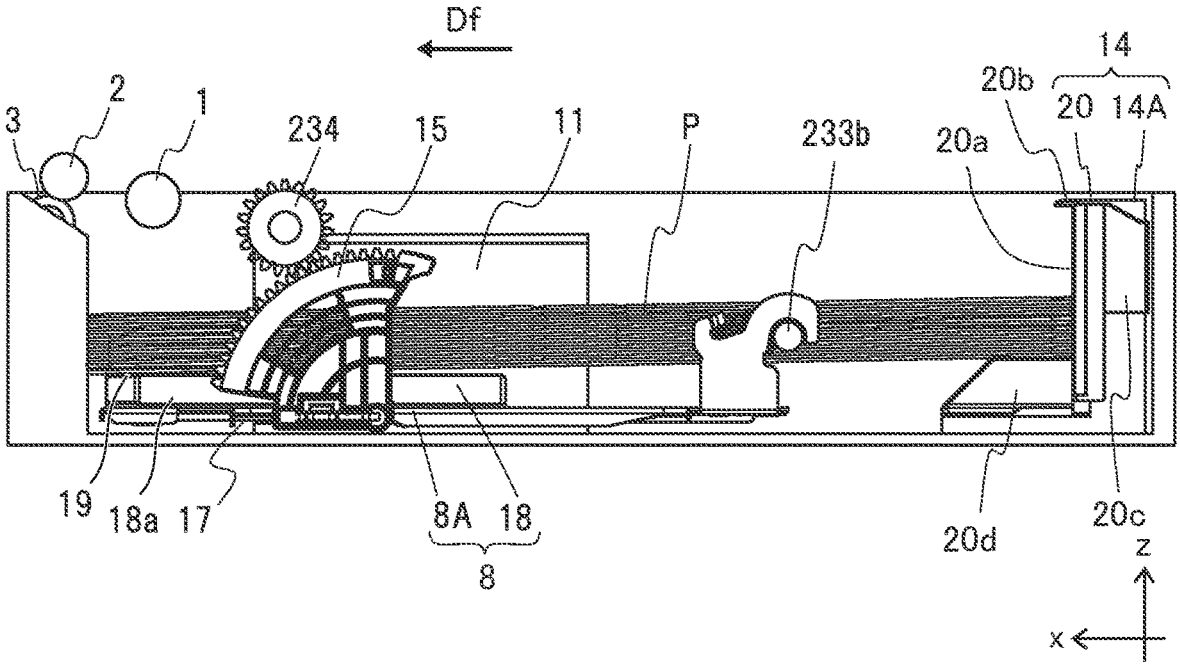
FIGS. 6A and 6B are each a section view for describing a feeding operation according to the first embodiment.
Figure 6B:
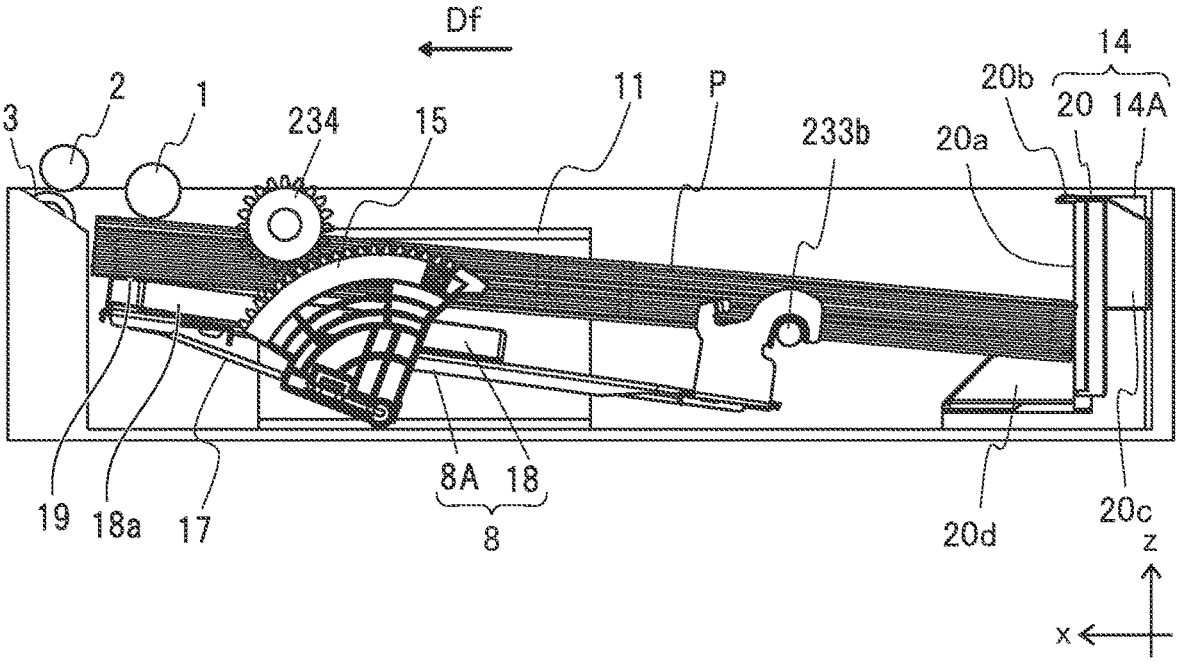

The friction sheet 19 is disposed downstream of the front supporting stage 18*a* in the sheet feeding direction Df. The friction sheet 19 is disposed below the feeding roller 1 as illustrated in FIGS. 6A and 6B. The friction sheet 19 is a friction portion that increases the frictional force between the lifter tray 8 and the lowermost sheet such that the alignment of the sheet stack placed on the front supporting stage 18*a* is not disturbed by the force received from the feeding roller 1 while feeding. As the friction sheet 19, a sheet material having a higher friction coefficient with a typical material of envelopes such as paper than the surface of the front supporting stage 18*a* is used, and for example, a rubber sheet or a resin sheet having a roughened surface may be used. In addition, instead of sticking a sheet material, part of the surface of the tray attachment 18 may be roughened as a friction portion. To be noted, by setting the width of the friction sheet 19 in the sheet width direction Dw to be larger than the width of the center portion a1 of the front supporting stage 18*a*, a contact area between the friction sheet 19 and the sheet can be secured.

At least one engaging portion 18*c* projecting downward is provided at a lower portion of the tray attachment 18. Meanwhile, at least one engaged portion 8*c* that the at least one engaging portion 18*c* engages with is provided at a position corresponding to the engaging portion 18*c* in the tray body 8A. In the illustrated embodiment, three engaging portions 18*c* and three engaged portions 8*c* are provided, and only one of the engaging portions 18*c* is visible in FIG. 4A. For example, lower end portions of the engaging portions 18*c* are preferably formed in shapes bent downstream in a claw shape in the sheet feeding direction Df such that the engaging portions 18*c* are not disengaged from the engaged portions 8*c* by the force in the sheet feeding direction Df.

As illustrated in FIGS. 4A and 4B, the user can attach the tray attachment 18 to the tray body 8A by gripping the tray attachment 18, moving the tray attachment 18 from the upper side to the lower side, and engaging the engaging portions 18*c* with the engaged portions 8*c*. In addition, the user can detach the tray attachment 18 attached to the tray body 8A from the tray body 8A by gripping the tray attachment 18, disengaging the engaging portions 18*c* from the engaged portions 8*c*, and then lifting up the tray attachment 18.

Trailing-End Attachment

The trailing-end attachment 20 includes the regulating surface 20A, a rear supporting stage 20*d* serving as an envelope rear portion supporting stage, claw portions 20*b*, and an attaching portion 20*c*.

The rear supporting stage 20*d* is a member having a thin and elongated shape in which a projecting shape whose center portion d1 (see FIG. 7C) in the sheet width direction Dw projects upward as compared with end portions d2 thereof in the sheet width direction Dw continuously extends in the sheet feeding direction Df. The rear supporting stage 20*d* extends downstream in the sheet feeding direction Df from the regulating surface 20*a* of the trailing-end regulating member 14. The downstream end of the rear supporting stage 20*d* in the sheet feeding direction Df is an inclined surface inclined downward toward the downstream side in the sheet feeding direction Df.

The rear supporting stage 20*d* is disposed at a center portion of the lifter tray 8 in the sheet width direction Dw. Specifically, as illustrated in FIG. 3A, the rear supporting stage 20*d* is disposed at a position overlapping the conveyance center y0 as viewed from above, and preferably a center portion d1 of the rear supporting stage 20*d* is positioned on the conveyance center y0. In addition, the rear supporting stage 20*d* and the front supporting stage 18*a* are preferably disposed such that a center line of the rear supporting stage 20*d* in the sheet width direction Dw coincides with a center line of the front supporting stage 18*a* in the sheet width direction Dw.

As described above, the front supporting stage 18*a* of the tray attachment 18 and the rear supporting stage 20*d* of the trailing-end attachment 20 are each formed in a projecting shape whose center portion in the sheet width direction Dw projects upward. The rear supporting stage 20*d* functions as a first support portion that is provided in the trailing-end regulating member 14 and supports the lower surface of the sheets. Meanwhile, the front supporting stage 18*a* of the lifter tray 8 functions as a second support portion that supports the lower surface of the sheets at a position downstream of the first support portion in the sheet feeding direction Df.

The front supporting stage 18*a* is provided on the tray body 8A of the lifter tray 8, and ascends and descends together with the tray body 8A. In contrast, the rear supporting stage 20*d* is provided as part of the trailing-end regulating member 14 supported by the bottom portion 16 of the feed cassette 233, and does not ascend or descend even when the lifter tray 8 ascends or descends. In addition, the front supporting stage 18*a* is positioned with respect to the lifter tray 8 serving as a stacking portion such that the front supporting stage 18*a* does not move even when the trailing-end regulating member 14 is moved in the sheet feeding direction Df. In other words, the trailing-end regulating member 14 is relatively movable in the sheet feeding direction Df with respect to the front supporting stage 18*a*.

The length of the front supporting stage 18*a* in the sheet feeding direction Df is larger than the length of the rear supporting stage 20*d* in the sheet feeding direction Df. As a result of this, a space required for providing the trailing-end regulating member 14 that is a member movable in the sheet feeding direction Df can be made smaller.

Here, the projecting height of the first support portion is preferably set to be larger than the projecting height of the second support portion. The projecting height of the first support portion is a distance in the up-down direction from the upper surface of the stacking portion capable of supporting a sheet on both sides of the first support portion in the sheet width direction to the center portion of the first support portion in a cross-section of the sheet feeding apparatus taken along a plane (y-z plane) passing through the first support portion and perpendicular to the sheet feeding direction. The projecting height of the second support portion is a distance in the up-down direction from the upper surface of the stacking portion capable of supporting a sheet on both sides of the second support portion in the sheet width direction to the center portion of the second support portion in a cross-section of the sheet feeding apparatus taken along a plane (y-z plane) passing through the second support portion and perpendicular to the sheet feeding direction.

In the present embodiment, the rear supporting stage 20*d* projects with respect to the bottom portion 16 of the feed cassette 233, and the front supporting stage 18A projects with respect to the tray body 8A of the lifter tray 8. Therefore, the projecting height (h2 in FIG. 7C) of the rear supporting stage 20*d* with respect to the bottom portion 16 of the feed cassette 233 is set to be larger than the projecting height (h1 in FIG. 7C) of the front supporting stage 18*a* with respect to the tray body 8A.

Whereas the front supporting stage 18*a* has a trapezoidal cross-section along a plane perpendicular to the sheet feeding direction Df, the rear supporting stage 20*d* has a triangular cross-section along the plane perpendicular to the sheet feeding direction Df. To be noted, the front supporting stage 18*a* and the rear supporting stage 20*d* may have any shape as long as the shape is a projecting shape that supports the center portion of the lower surface of the sheet stack in the sheet width direction Dw. For example, the rear supporting stage 20*d* may be formed to have a trapezoidal shape in section view, or may be formed in a different projecting shape such as a shape having a semicircular cross-section.

In addition, the widths of the center portions a1 and d1 of the front supporting stage 18*a* and the rear supporting stage 20*d* in the sheet width direction Dw are each set to be smaller than the width of a sheet having the smallest width in the sheet width direction Dw among sheets that are compatible with the feed cassette 233. Specifically, in a state in which the side-end regulating members 10 and 11 have been moved to the most inner positions, the center portions a1 and d1 of the front supporting stage 18*a* and the rear supporting stage 20*d* are positioned further on the inside than the regulating surfaces 24*a* and 25*a* in the sheet width direction Dw. In addition, the widths of the center portions a1 and d1 are set to be ½ or less, preferably ⅓ of the widths of the regulating surfaces 24*a* and 25*a* in a state in which the side-end regulating members 10 and 11 have been moved to the most inner positions. This is because if the widths of the center portions a1 and d1 that come into contact with the lower surface of the sheet stack are small, the variation in the stack height of the sheet stack derived from the unevenness of the thickness of the sheet is more likely to be absorbed by the space between the center portions a1 and d1 and the regulating surfaces 24*a* and 25*a*.

The claw portions 20*b* are projection portions serving as first projection portions projecting downstream in the sheet feeding direction Df from the upper end of the regulating surface 20*a*. The claw portions 20*b* have a function of restricting the uppermost sheet of the sheet stack supported on the lifter tray 8 from sticking out beyond the upper end of the regulating surface 20*a*.

The attaching portion 20*c* is provided on the back side of the regulating surface 20*a*, that is, on the upstream side of the regulating surface 20*a* in the sheet feeding direction Df. The attaching portion 20*c* is constituted by a pair of hook-shaped members opposing each other in the sheet width direction Dw as viewed from above, and a space for accepting the body portion 14A of the trailing-end regulating member 14 is defined between the pair of hook-shaped members.

As illustrated in FIGS. 4A and 4B, the user can attach the trailing-end attachment 20 to the body portion 14A by gripping the trailing-end attachment 20, moving the trailing-end attachment 20 from the upper side to the lower side, and fitting the body portion 14A of the trailing-end regulating member 14 in the attaching portion 20*c*. In addition, the user can detach the trailing-end attachment 20 from the body portion 14A by gripping and moving up the trailing-end attachment 20 attached to the body portion 14A.

Side-End Attachments

The side-end attachments 24 and 25 respectively include regulating surfaces 24*a* and 25*a*, claw portions 24*b* and 25*b*, and attaching portions 24*c* and 25*c* as illustrated in FIGS. 3A, 4A, and 4B.

The claw portions 24*b* and 25*b* are projection portions serving as second projection portions projecting inward in the sheet width direction Dw respectively from the upper ends of the regulating surfaces 24*a* and 25*a*. The claw portions 24*b* and 25*b* have a function of restricting the uppermost sheet of the sheet stack supported on the lifter tray 8 from sticking out beyond the upper ends of the regulating surfaces 24*a* and 25*a*.

The attaching portions 24*c* and 25*c* are respectively provided on the back side of the regulating surfaces 24*a* and 25*a*, that is, on the outside of the regulating surfaces 24*a* and 25*a* in the sheet width direction Dw. The attaching portions 24*c* and 25*c* are each constituted by a pair of hook-shaped members opposing each other in the sheet feeding direction Df as viewed from above, and a space for accepting the body portion 10A or 11A of the side-end regulating member 10 or 11 is defined between the pair of hook-shaped members.

As illustrated in FIGS. 4A and 4B, the user grips the side-end attachments 24 and 25, moves the side-end attachments 24 and 25 from the upper side to the lower side, and fits the body portions 10A and 11A of the side-end regulating members 10 and 11 in the attaching portions 24*c* and 25*c*. As a result of this, the user can attach the side-end attachments 24 and 25 to the body portions 10A and 11A. In addition, the user can detach the side-end attachments 24 and 25 from the body portions 10A and 11A by gripping and moving up the side-end attachment 24 and 25 attached to the body portions 10A and 11A.

As described above, in the present embodiment, the feed cassette 233 takes a state suitable for supporting envelopes, by attaching the attachments 18, 20, 24, and 25 from above in a state in which the feed cassette 233 is drawn out from the printer body 201A. In addition, by detaching the attachments 18, 20, 24, and 25 to the upper side in the state in which the feed cassette 233 is drawn out from the printer body 201A, the feed cassette 233 takes a state suitable for supporting sheets other than envelopes. As described above, the user can easily change the state of the feed cassette 233 in accordance with the use purpose without needing a complex operation or a tool, and thus the usability can be improved.

Figure 5A:
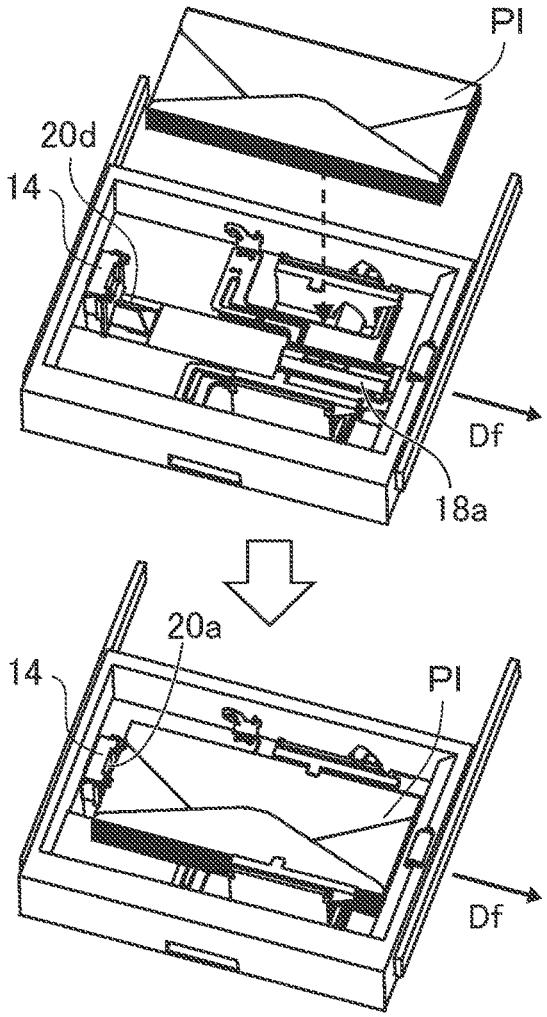
FIGS. 5A and 5B are diagrams illustrating how envelope stacks of different sizes are set in the feed cassette according to the first embodiment.
Figure 5B:
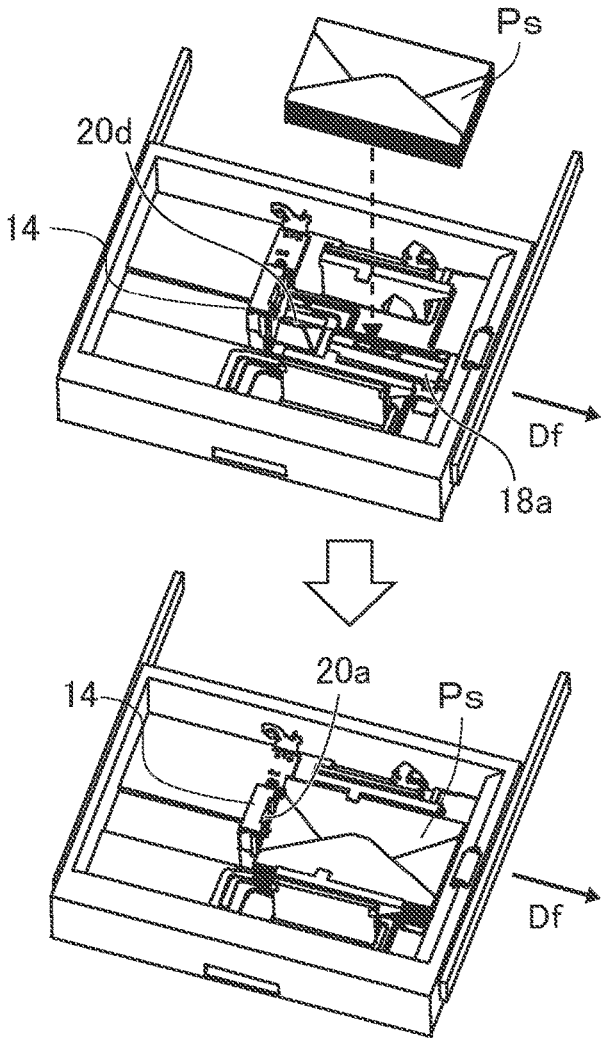

In addition, in the present embodiment, the rear supporting stage 20*d* that swingably supports the trailing end of the sheets is disposed at the trailing-end regulating member 14, and therefore sheets of various sizes can be handled. FIG. 5A illustrates how an envelope stack Pl having a large length in the sheet feeding direction Df is placed in the feed cassette 233 to which the attachments 18, 20, 24, and 25 are attached. FIG. 5B illustrates how an envelope stack Ps having a small length in the sheet feeding direction Df is placed in the feed cassette 233 to which the attachments 18, 20, 24, and 25 are attached.

As illustrated in FIGS. 5A and 5B, by moving the trailing-end regulating member 14 in accordance with the length of the envelope stack Pl or Ps, the rear supporting stage 20*d* can move to a position where the rear supporting stage 20*d* can support the lower surface of the trailing end portion of the envelope stack Pl or Ps.

Feeding Operation

Next, the control performed for ascension/dissension of the lifter tray 8 and for the feeding operation will be described with reference to FIGS. 6A and 6B. FIGS. 6A and 6B are each a section view of the sheet feeding apparatus 230 taken along a plane perpendicular to the sheet width direction Dw (y direction) in a state in which an envelope stack P is placed on the front supporting stage 18*a* of the lifter tray 8 and the rear supporting stage 20*d* of the trailing-end regulating member 14. FIG. 6A illustrates a state before the lifter tray 8 ascends, and FIG. 6B illustrates a state after the lifter tray 8 has ascended.

As illustrated in FIG. 6A, in the case of setting the envelope stack Pin the feed cassette 233, the user places the envelope stack P in the feed cassette 233 drawn out from the printer body 201A, and then moves the side-end regulating members 10 and 11 and the trailing-end regulating member 14 in accordance with the size of the envelope. Then, when the feed cassette 233 is attached to the printer body 201A, the lifter gear 15 of the feed cassette 233 engages with a drive gear 234 of the printer body 201A.

When it is determined that the feed cassette 233 has been attached, the controller of the printer body 201A rotates the drive gear 234 by starting rotation of a motor. As a result of this, the lifter gear 15 engaged with the drive gear 234 rotates, and thus the lifter arm 17 pivots together with the lifter gear 15. As a result of this, as illustrated in FIG. 6B, the lower surface of the lifter tray 8 is pressed by the lifter arm 17, thus the lifter tray 8 swings upward about the swing shaft 233*b*, and the uppermost envelope abuts the feeding roller 1.

To be noted, an urging member such as a spring that urges the feeding roller 1 downward and an unillustrated sensor that detects the height of the feeding roller 1 reaching a predetermined position where feeding of the envelope is possible are provided in the printer body 201A. In the case where the lifter tray 8 further ascends from a time point when the uppermost envelope has come into contact with the feeding roller 1 and the sensor issues a signal indicating that the height of the feeding roller 1 has reached a predetermined position, the controller stops the rotation of the motor and stops the ascension of the lifter tray 8. As a result of this, it becomes possible to start the feeding operation by rotational driving of the feeding roller 1.

When the amount of stack of the envelope stack P and the height of the upper surface of the envelope stack P are reduced as a result of the feeding operation, the sensor issues a signal indicating that the height of the feeding roller 1 has become smaller than that of a predetermined position. Then, the controller starts rotating the motor, lifts the lifter tray 8 by a predetermined amount, and then stops the rotation of the motor. As a result of this, while the feeding operation is executed, the height of the upper surface of the envelope stack P is kept approximately constant, and the envelopes are sequentially fed by the feeding roller 1 starting from the uppermost envelope.

Function of Envelope Attachments

As described above, the feed cassette 233 of the present embodiment takes a state suitable for supporting sheets of uneven thickness such as envelopes by attaching the attachments 18, 20, 24, and 25 thereto.

Figure 7A:
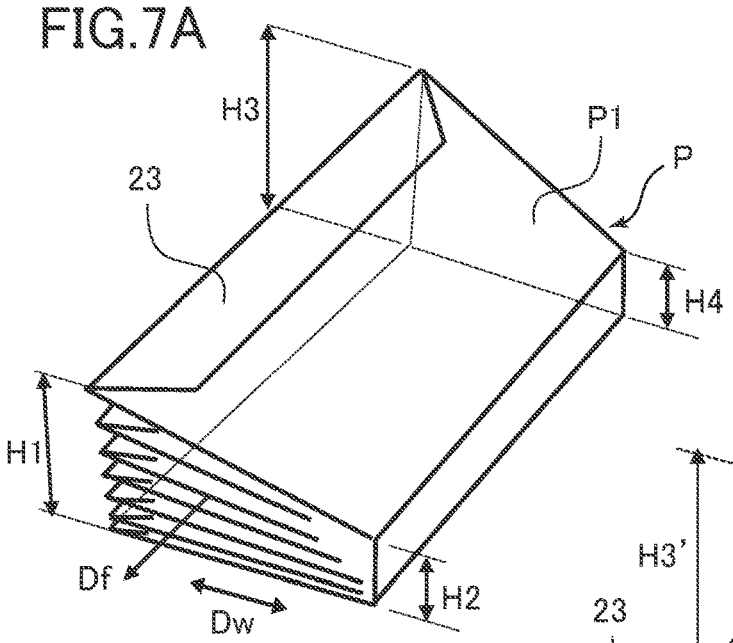
FIGS. 7A to 7C are each a schematic diagram for describing functions of a configuration according to the first embodiment.

FIG. 7A illustrates a state in which the envelope stack P having flaps 23 provided along one of the long sides thereof are placed on a horizontal surface. In this case, the thickness of each envelope is uneven due to the flap 23, and therefore stacking heights H1, H2, H3, and H4 at four corners of the envelope stack P vary, and the height of the side on which the flap 23 is provided is larger than the height on the side on which the flap 23 is not provided. That is, H1>H2 and H3>H4 hold.

A case where the envelope stack P illustrated in FIG. 7A is set in the feed cassette 233 in a long-side feeding orientation in which the long-side direction of the envelope stack P is parallel to the sheet feeding direction Df and the short-side direction of the envelope stack P is parallel to the sheet width direction Dw is assumed. In this case, if no measure is taken in the feed cassette 233, the contact pressure between the feeding roller 1 and the envelope stack P is biased at some part in the sheet width direction Dw, that is, biased contact occurs due to the unevenness of the height of the envelope stack P caused by the flap 23. Such biased contact of the feeding roller 1 leads to occurrence of a feeding failure in which the feeding roller 1 cannot normally feed the uppermost envelope.

In addition, as a result of the feeding roller 1 pressing the envelope stack P at the time of feeding, the inclination of the trailing end of the envelope stack P can become larger than the inclination of the leading end of the envelope stack Pin some cases. This will be described next.

Figure 7B:
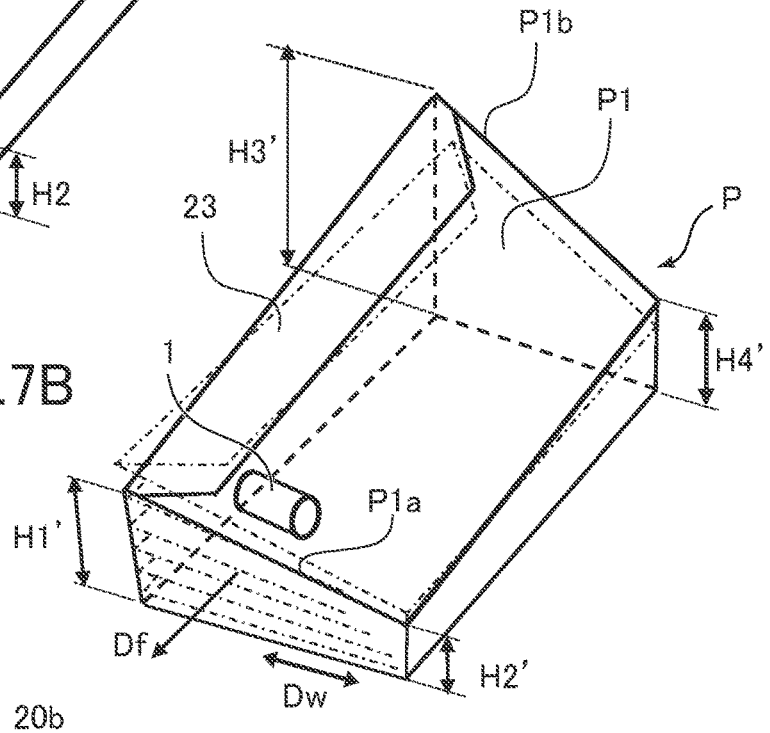

As illustrated in FIG. 7B, when the lifter tray 8 ascends and the envelope stack P abuts the feeding roller 1, the envelope stack P is compressed by the feeding roller 1, and thus the stacking heights H1 and H2 of the leading end portion of the envelope stack P become smaller. The stacking heights of the leading end portion of the envelope stack Pin this state will be referred to as H1' and H2'. That is, as compared with the state of FIG. 7A, H1'<H1 and H2'<H2 hold.

In the state of FIG. 7B, in the part not receiving the pressing force from the feeding roller 1, that is, in the part upstream of and away from the feeding roller 1 in the sheet feeding direction Df, the thickness per envelope is the same as before the envelope stack P abuts the feeding roller 1. Therefore, when the leading end portion of the envelope stack P is compressed by the feeding roller 1 and the stacking height thereof is reduced, the envelope stack P takes an approximately fan-shaped form centered on the leading end portion thereof as viewed in the sheet width direction Dw. As a result of this, the stacking heights H3 and H4 of the trailing end portion of the envelope stack P becomes larger than before the envelope stack P abuts the feeding roller 1. The stacking heights of the trailing end portion of the envelope stack P in this state will be referred to as H3' and H4'. That is, as compared with the state of FIG. 7A, H3'>H3 and H4'>H4 hold.

Here, the stacking heights of the trailing end portion of the envelope stack P become larger on the flap 23 side where the thickness per envelope is larger. As a result, a stacking height difference in the sheet width direction Dw of the trailing end portion of the envelope stack P becomes larger than before the envelope stack P abuts the feeding roller 1. That is, H3'−H4'>H3−H4 holds.

Therefore, in the case where the envelope stack P is set, the inclination of an uppermost envelope P1 can become large especially at a trailing end P1*b* as a result of the feeding roller 1 pressing the envelope stack P. In the case where the orientation of the uppermost envelope P1 is greatly inclined at the trailing end portion of the envelope stack P as described above, there is a possibility that a feeding failure of the feeding roller 1 occurs.

Supplementary description of the occurrence of the feeling failure caused by the inclination of the trailing end portion of the envelope stack P will be given. A case where the feeding roller 1 has started feeding of the uppermost envelope P1 in a state in which the leading end portion of the envelope stack P is pressed by the feeding roller 1 as illustrated in FIG. 7B is assumed. In this case, the inclination of the trailing end P1*b* of the uppermost envelope P1 representing the height difference between end portions thereof in the sheet width direction Dw decreases from H3'−H4' to H1'−H2' as the trailing end P1*b* approaches the feeding roller 1. That is, it can be considered that even in the state in which the inclination of the trailing end portion of the envelope stack P has increased due to the pressing force of the feeding roller 1, the inclination of the uppermost envelope P1 at the contact position with the feeding roller 1 is approximately constant.

However, in the case where the inclination of the uppermost envelope P1 is different between the leading end P1*a* and the trailing end P1*b*, the envelope P1 is twisted, and a torsional stress to cancel the inclination difference between the leading end P1*a* and the trailing end P1*b* is generated in the envelope P1. Specifically, in the case where the envelope P1 is viewed from the downstream side in the sheet feeding direction Df in the state of FIG. 7B, a tortional stress to rotate the leading end P1*a* in the clockwise direction is generated in the envelope P1. A similar torsional stress is also generated in envelopes under the uppermost envelope P1 that have the inclination difference between the leading end and the trailing end thereof.

Due to this tortional stress, the pressing force (contact pressure) by which the uppermost envelope P1 presses the feeding roller 1 increases on the same side as the flap 23 in the sheet width direction Dw, and the pressing force (contact pressure) by which the uppermost envelope P1 presses the feeding roller 1 decreases on the side opposite to the flap 23. That is, in the state in which the inclination of the trailing end portion of the envelope stack P has increased as a result of the feeding roller 1 pressing the envelope stack P, the balance of the contact pressure between the feeding roller 1 and the envelope P1 is disturbed due to the tortional stress generated in the envelope stack P.

Figure 7C:
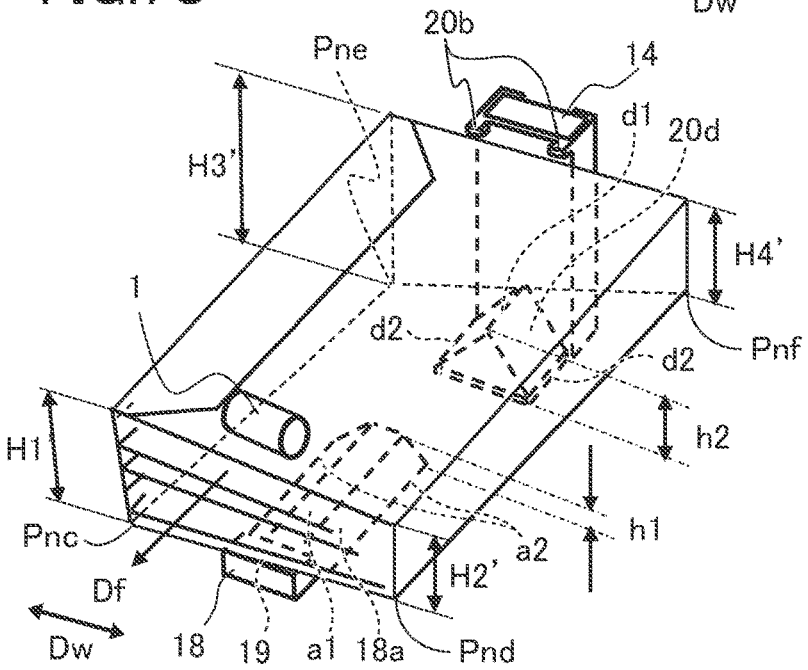

Here, as illustrated in FIG. 7C, part of the envelope stack P on the leading end side is supported by the front supporting stage 18*a* having a projecting shape. In this case, the stacking height difference at the leading end portion of the envelope stack P, that is, the difference between H1' and H2' is absorbed by the space on the both sides of the front supporting stage 18*a* in the sheet width direction Dw. Specifically, a corner portion Pnc of the lower surface of the envelope stack P that is on the leading end side in the sheet feeding direction Df and on the same side as the flap 23 in the sheet width direction Dw is allowed to be positioned lower than the center portion a1 of the front supporting stage 18*a* having the projecting shape. Meanwhile, a corner portion Pnd of the lower surface of the envelope stack P that is on the leading end side in the sheet feeding direction Df and on the opposite side to the flap 23 in the sheet width direction Dw is allowed to be positioned higher than the center portion a1 of the front supporting stage 18*a*. Therefore, even in the state in which there is a stacking height difference at the leading end portion of the envelope stack P, that is, even in the state in which there is a difference between H1' and H2', the inclination of the leading end P1*a* of the uppermost envelope P1 can be made closer to 0. The inclination of the leading end P1*a* being 0 means that the leading end P1*a* is horizontal.

However, even in the case where the inclination of the leading end P1*a* of the uppermost envelope P1 is made closer to 0 by the front supporting stage 18*a*, if the inclination of the trailing end portion of the envelope stack P is still large, there is a possibility that a feeding failure of the feeding roller 1 occurs as described above. To address this, it is desired to reduce the inclination of the trailing end portion of the envelope stack P.

To be noted, as a different method for reducing the biased contact of the feeding roller 1 in the case of feeding a sheet having an uneven thickness such as an envelope, providing a supporting stage swingable about a swing shaft passing through a center portion in the sheet width direction Dw instead of the front supporting stage 18*a* can be also considered. Also in this case, if the inclination of the trailing end portion of the envelope stack P is kept large, there is a possibility that a feeding failure of the feeding roller 1 occurs.

Therefore, in the present embodiment, as illustrated in FIG. 7C, a configuration in which the lower surface of the trailing end portion of the envelope stack P is supported by the rear supporting stage 20*d* having a projecting shape is employed. In this case, the stacking height difference (H3'–H4') at the trailing end portion of the envelope stack P is absorbed by the space on the both sides of the rear supporting stage 20*d* in the sheet width direction Dw. Specifically, a corner portion Pne of the lower surface of the envelope stack P that is on the trailing end side in the sheet feeding direction Df and on the same side as the flap 23 in the sheet width direction Dw is allowed to be positioned lower than the center portion d1 of the rear supporting stage 20*d* having the projecting shape. Meanwhile, a corner portion Pnf of the lower surface of the envelope stack P that is on the trailing end side in the sheet feeding direction Df and on the opposite side to the flap 23 in the sheet width direction Dw is allowed to be positioned higher than the center portion d1 of the rear supporting stage 20*d*. Therefore, even in the state in which there is a stacking height difference at the trailing end portion of the envelope stack P, that is, even in the state in which there is a difference between H3' and H4', the inclination of the trailing end P1*b* of the uppermost envelope P1 can be made closer to 0.

As described above, according to the present embodiment, by supporting the lower surface of the trailing end portion of the envelope stack P by the rear supporting stage 20*d* having the projecting shape, the inclination of the trailing end P1*b* of the uppermost envelope P1 can be made closer to 0, and thus the occurrence of a feeding failure can be reduced. That is, according to the present embodiment, sheets of various sizes having uneven thickness can be fed more stably.

Here, as described above, the projecting height h2 of the rear supporting stage 20*d* is set to be larger than the projecting height h1 of the front supporting stage 18*a*. That is, h1<h2 holds. This corresponds to the fact that, as described above, the stacking height difference (H3'–H4') at the rear end portion of the envelope stack P is larger than the stacking height difference (H1'–H2') at the leading end portion of the envelope stack Pin the state in which the envelope stack P is pressed by the feeding roller 1 as illustrated in FIG. 7B. That is, by setting the projecting height h2 of the rear supporting stage 20*d* to be larger than the projecting height h1 of the front supporting stage 18*a*, the inclination of the trailing end P1*b* of the uppermost envelope P1 can be made closer to 0.

In addition, while envelopes are typically manufactured by folding and gluing original paper, the shapes of the envelopes and the direction and position of the gluing vary widely. Further, if the envelopes are exposed to a low-humidity or low-temperature environment, warpage or curl can occur in the envelopes depending on the variation of the direction and position of the gluing. If an envelope stack warped or curled in this manner is supported in the feed cassette 233 and pressed by the feeding roller 1, the stacking height difference of the envelope stack in the sheet width direction Dw can become even larger due to the warpage or curl.

Even in such a state, according to the configuration of the present embodiment, the inclination of the trailing end P1*b* of the uppermost envelope P1 can be made closer to 0 by the rear supporting stage 20*d*, and thus occurrence of a feeding failure can be reduced.

In addition, when the envelope stack P is pressed by the feeding roller 1, the uppermost envelope P1 sometimes moves beyond the upper end of the regulating surface 20*a* of the trailing-end regulating member 14 or the upper end of the regulating surface 24*a* or 25*a* of the side-end regulating member 10 or 11. In this case, there is a possibility that the envelope P1 released from the regulation by the regulating surfaces 20*a*, 24*a*, and 25*a* turns while feeding and thus is skewed greatly, and a conveyance failure or displacement of the image occurs.

In contrast, in the present embodiment, since the claw portions 20*b* projecting from the upper end of the regulating surface 20*a* of the regulating member 14 are provided, sticking out of the trailing end P1*b* of the uppermost envelope P1 beyond the regulating surface 20*a* can be restricted. Similarly, in the present embodiment, since the claw portions 24*b* and 25*b* projecting from the upper ends of the regulating surfaces 24*a* and 25*a* of the side-end regulating members 10 and 11 are provided, sticking out of the side-ends of the uppermost envelope P1 beyond the regulating surfaces 24*a* and 25*a* can be restricted. As a result of this, the possibility of occurrence of the conveyance failure and the displacement of the image caused by movement of the uppermost envelope P1 beyond the regulating surfaces 20*a*, 24*a*, and 25*a* during feeding can be lowered.

Modification Example

In the present embodiment described above, a configuration in which the front supporting stage 18*a* having a projecting shape and the rear supporting stage 20*d* having a projecting shape are used together has been described. However, as described with reference to FIG. 7B, the stacking height difference at the trailing end portion of the envelope stack P is larger than the stacking height difference at the leading end portion of the envelope stack P in the state in which the feeding roller 1 is pressing the envelope stack P. Therefore, the occurrence of the conveyance failure can be also reduced by a configuration in which the front supporting stage 18*a* is omitted and only the rear supporting stage 20*d* is provided.

Second Embodiment

Figure 8A:
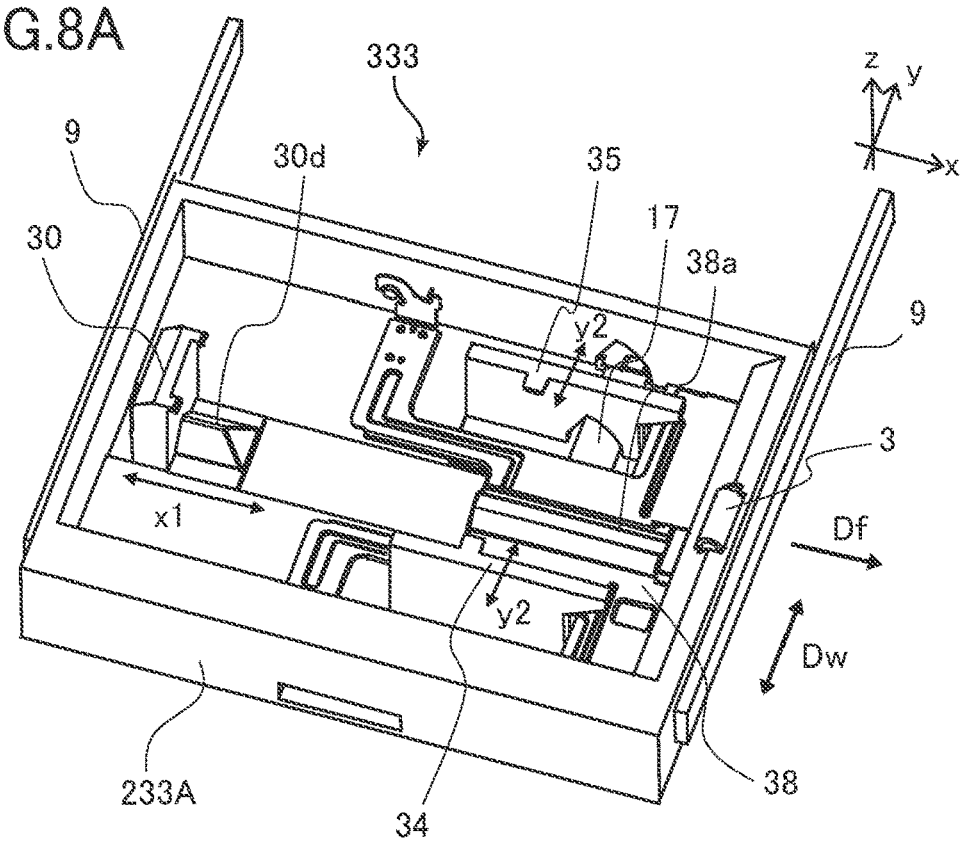
FIG. 8A is a perspective view of a feed cassette according to a second embodiment.
Figure 8B:
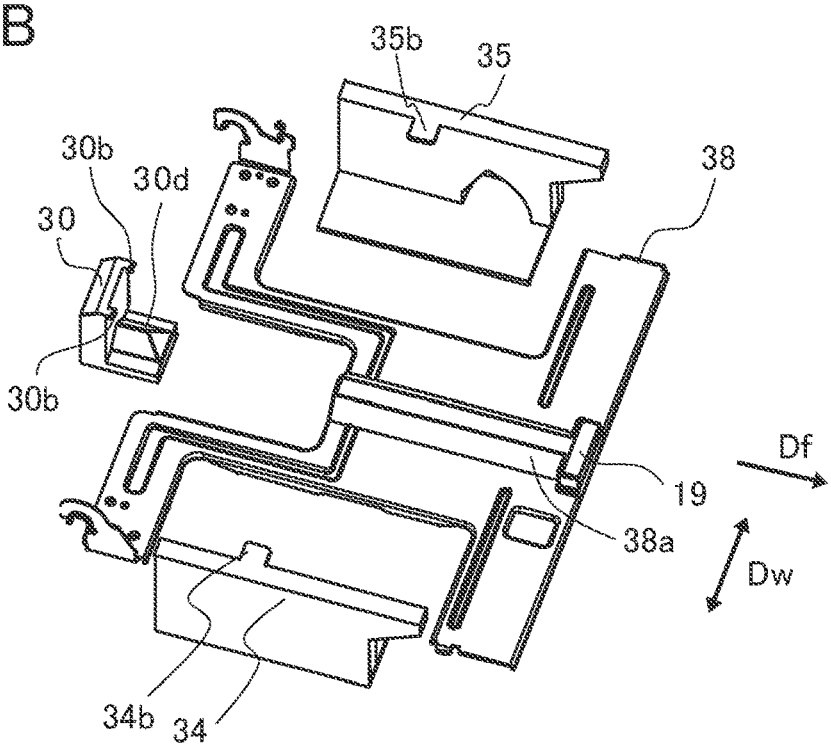
FIG. 8B is a perspective view of some members of the feed cassette according to the second embodiment.

Next, a feed cassette 333 according to a second embodiment of the present disclosure will be described with reference to FIGS. 8A and 8B. The feed cassette 333 according to the present embodiment is a unit constituting part of the sheet feeding apparatus 230 and detachably attached to the printer body 201A illustrated in FIG. 1 similarly to the feed cassette 233 of the first embodiment. FIG. 8A is a perspective view of the feed cassette 333 according to the present embodiment. FIG. 8B is a perspective view of some members of the feed cassette 333.

The feed cassette 333 according to the present embodiment is different from the feed cassette 233 of the first embodiment in the configuration inside the cassette. In the description below, it is assumed that elements denoted by the same reference signs as in the first embodiment have substantially the same configurations and functions as those described in the first embodiment, and part different from the first embodiment will be mainly described.

As illustrated in FIGS. 8A and 8B, the feed cassette 333 includes the cassette body 233A, a lifter tray 38, the lifter arm 17, a pair of side-end regulating members 34 and 35, a trailing-end regulating member 30, the slide rails 9, and the separation roller 3.

The lifter tray 38 has a shape in which the tray body 8A and the tray attachment 18 of the first embodiment are integrated. Therefore, the lifter tray 38 includes a front supporting stage 38*a* having a projecting shape. The shape and position of the front supporting stage 38*a* can be set to be substantially the same as those of the front supporting stage 18*a* of the first embodiment.

The side-end regulating member 34 has a shape in which the body portion 11A of the side-end regulating member 11 and the side-end attachment 24 of the first embodiment are integrated. The side-end regulating member 35 has a shape in which the body portion 10A of the side-end regulating member 10 and the side-end attachment 25 of the first embodiment are integrated. The side-end regulating members 34 and 35 respectively include claw portions 34*b* and 35*b* that restrict the uppermost sheet from sticking out beyond the regulating surfaces of the side-end regulating members 34 and 35.

The trailing-end regulating member 30 has a shape in which the body portion 14A of the trailing-end regulating member 14 and the trailing-end attachment 20 of the first embodiment are integrated. Therefore, the trailing-end regulating member 30 includes the rear supporting stage 30*d* having a projecting shape. The shape and position of the rear supporting stage 30*d* can be set to be substantially the same as those of the rear supporting stage 20*d* of the first embodiment. In addition, the trailing-end regulating member 30 includes claw portions 30*b* that restrict the uppermost sheet from sticking out beyond the regulating surface of the trailing-end regulating member 30.

As described above, in the present embodiment, the elements such as the front supporting stage 18*a* and the rear supporting stage 30*d* suitable for supporting sheets having uneven thickness such as envelopes are not provided as attachments as in the first embodiment but are incorporated in the feed cassette 333 from the start. Therefore, in the case of supporting envelopes or the like, substantially the same merit as in the first embodiment can be obtained. In addition, in the case of using the feed cassette 233 exclusively for the purpose of feeding envelopes or the like, the sheet feeding apparatus can be simplified and the cost of the sheet feeding apparatus can be reduced by employing the feed cassette 333.

Other Examples

The printer 201 described in the embodiments described above is an example of an image forming apparatus. As the image forming portion, an image forming portion of a direct transfer system that directly transfers the toner image from the image bearing member onto the sheet may be used instead of the image forming portion 201B of the intermediate transfer system of a tandem type described above. In addition, the system of the image forming portion is not limited to an electrophotographic system, and an image forming unit of an inkjet system or an offset printing mechanism may be used as the image forming portion.

In addition, the sheet feeding apparatus is not limited to an apparatus provided as part of an image forming apparatus, and may be an optional feeder that is connected to the image forming apparatus and feeds a sheet toward the image forming apparatus. In addition, the sheet feeding apparatus may be an apparatus that feeds a sheet for a purpose other than image formation such as an apparatus that feeds a sheet (document) to be read in an image reading apparatus or an apparatus that feeds an envelope for inspecting what is inside the envelope.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-173907, filed on Oct. 25, 2021, which is hereby incorporated by reference herein in its entirety.

What is claimed is:

1. A sheet feeding apparatus comprising:

a stacking portion on which sheets are stacked;

a feed member provided above the stacking portion and configured to feed an uppermost sheet among the sheets stacked on the stacking portion toward a sheet feeding direction; and a trailing-end regulating member movable in the sheet feeding direction and configured to regulate a position of a trailing end of the sheets stacked on the stacking portion in the sheet feeding direction, wherein the trailing-end regulating member includes a support portion configured to support a lower surface of the sheets stacked on the stacking portion, wherein the support portion has a projecting shape in which a center portion of the support portion, in a sheet width direction, projects upward as compared with end portions of the support portion in the sheet width direction, the sheet width direction being a direction perpendicular to both the sheet feeding direction and an up-down direction, wherein the trailing-end regulating member further includes a body portion to which the support portion is detachably attached, and wherein the body portion from which the support portion is detached is capable of regulating the position of the trailing end of the sheets on the stacking portion.

2. The sheet feeding apparatus according to claim 1, wherein:

the support portion is a first support portion, the sheet feeding apparatus further comprises a second support portion provided downstream of the first support portion in the sheet feeding direction and configured to support the lower surface of the sheets stacked on the stacking portion, and the second support portion has a projecting shape in which a center portion of the second support portion, in the sheet width direction, projects upward as compared with end portions of the second support portion in the sheet width direction.

3. The sheet feeding apparatus according to claim 2, wherein a projecting height by which the first support portion projects upward with respect to the stacking portion is larger than a projecting height by which the second support portion projects upward with respect to the stacking portion.

4. The sheet feeding apparatus according to claim 2, further comprising:

a storage in which the sheets are stored, wherein the stacking portion includes:

a bottom portion of the storage; and a lifting/lowering member that is disposed at a position overlapping the feed member as viewed from above and is configured to ascend and descend with respect to the bottom portion, wherein the first support portion projects upward with respect to the bottom portion, and wherein the second support portion projects upward with respect to the lifting/lowering member.

5. The sheet feeding apparatus according to claim 2, wherein the center portion of the first support portion in the sheet width direction and the center portion of the second support portion in the sheet width direction are positioned on a straight line passing through a center portion in the sheet width direction of the feed member and extending in the sheet feeding direction as viewed from above.

6. The sheet feeding apparatus according to claim 2, further comprising a friction portion provided at a downstream end of the second support portion in the sheet feeding direction, the friction portion being configured to come into contact with the lower surface of the sheets on the stacking portion and reduce displacement of the sheets on the stacking portion caused by force received from the feed member.

7. The sheet feeding apparatus according to claim 2, wherein the second support portion is positioned with respect to the stacking portion so as not to move in the sheet feeding direction.

8. The sheet feeding apparatus according to claim 7, wherein a length of the second support portion in the sheet feeding direction is larger than a length of the first support portion in the sheet feeding direction.

9. The sheet feeding apparatus according to claim 1, wherein the trailing-end regulating member includes:

an abutting surface configured to abut the trailing end of the sheets stacked on the stacking portion; and a projection portion projecting downstream in the sheet feeding direction from an upper end of the abutting surface.

10. The sheet feeding apparatus according to claim 9, further comprising:

a pair of side-end regulating members each provided to be movable in the sheet width direction and each configured to regulate a position of a side end in the sheet width direction of the sheets stacked on the stacking portion, wherein the abutting surface is a first abutting surface, wherein the projection portion is a first projection portion, and wherein the pair of side-end regulating members each include:

a second abutting surface configured to abut a side end of the sheets on the stacking portion; and a second projection portion projecting inward in the sheet width direction from an upper end of the second abutting surface.

11. An image forming apparatus comprising:

the sheet feeding apparatus according to claim 1; and an image forming portion configured to form an image on a sheet fed by the sheet feeding apparatus.

12. A sheet feeding apparatus comprising:

a stacking portion on which sheets are stacked;

a feed member provided above the stacking portion and configured to feed an uppermost sheet among the sheets stacked on the stacking portion toward a sheet feeding direction; and a trailing-end regulating member movable in the sheet feeding direction and configured to regulate a position of a trailing end of the sheets stacked on the stacking portion in the sheet feeding direction, wherein:

the trailing-end regulating member includes a first support portion configured to support a lower surface of the sheets stacked on the first stacking portion, and the first support portion has a projecting shape in which a center portion of the support portion, in a sheet width direction, projects upward as compared with end portions of the first support portion in the sheet width direction, the sheet width direction being a direction perpendicular to both the sheet feeding direction and an up-down direction;

a second support portion provided downstream of the first support portion in the sheet feeding direction and configured to support the lower surface of the sheets stacked on the stacking portion, wherein:

the second support portion has a projecting shape in which a center portion of the second support portion, in the sheet width direction, projects upward as compared with end portions of the second support portion in the sheet width direction; and a friction portion provided at a downstream end of the second support portion in the sheet feeding direction, the friction portion being configured to come into contact with the lower surface of the sheets on the stacking portion and reduce displacement of the sheets on the stacking portion caused by force received from the feed member.

13. The sheet feeding apparatus according to claim 12, wherein a projecting height by which the first support portion projects upward with respect to the stacking portion is larger than a projecting height by which the second support portion projects upward with respect to the stacking portion.

14. The sheet feeding apparatus according to claim 12, further comprising:

a storage in which the sheets are stored, wherein the stacking portion includes:

a bottom portion of the storage; and a lifting/lowering member that is disposed at a position overlapping the feed member as viewed from above and is configured to ascend and descend with respect to the bottom portion, wherein the first support portion projects upward with respect to the bottom portion, and wherein the second support portion projects upward with respect to the lifting/lowering member.

15. The sheet feeding apparatus according to claim 12, wherein the center portion of the first support portion in the sheet width direction and the center portion of the second support portion in the sheet width direction are positioned on a straight line passing through a center portion in the sheet width direction of the feed member and extending in the sheet feeding direction as viewed from above.

16. The sheet feeding apparatus according to claim 12, wherein the second support portion is positioned with respect to the stacking portion so as not to move in the sheet feeding direction.

17. The sheet feeding apparatus according to claim 16, wherein a length of the second support portion in the sheet feeding direction is larger than a length of the first support portion in the sheet feeding direction.

18. The sheet feeding apparatus according to claim 12, wherein the trailing-end regulating member includes:

an abutting surface configured to abut the trailing end of the sheets stacked on the stacking portion; and a projection portion projecting downstream in the sheet feeding direction from an upper end of the abutting surface.

19. The sheet feeding apparatus according to claim 18, further comprising:

a pair of side-end regulating members each provided to be movable in the sheet width direction and each configured to regulate a position of a side end in the sheet width direction of the sheets stacked on the stacking portion, wherein the abutting surface is a first abutting surface, wherein the projection portion is a first projection portion, and wherein the pair of side-end regulating members each include:

a second abutting surface configured to abut a side end of the sheets on the stacking portion; and a second projection portion projecting inward in the sheet width direction from an upper end of the second abutting surface.

20. An image forming apparatus comprising:

the sheet feeding apparatus according to claim 12; and an image forming portion configured to form an image on a sheet fed by the sheet feeding apparatus.

* * * * *